United States Patent [19]

Nystad

[11] Patent Number: 4,727,607

[45] Date of Patent: Mar. 1, 1988

[54] WATER BED

[76] Inventor: Jan R. Nystad, Elverhoy, N-2313 Ottestad, Norway

[21] Appl. No.: 943,934

[22] Filed: Dec. 19, 1986

[30] Foreign Application Priority Data

Dec. 20, 1985 [NO] Norway ..... 855218

[51] Int. Cl.[4] ..... A47C 27/08

[52] U.S. Cl. ..... 5/450; 5/451

[58] Field of Search ..... 5/451, 450, 449, 455, 5/465, 458, 452

[56] References Cited

U.S. PATENT DOCUMENTS

| | | | |
|---|---|---|---|
| 3,670,347 | 6/1972 | Weinstein | 5/451 |
| 3,746,835 | 7/1973 | Yu et al. | 5/451 |
| 3,803,647 | 4/1974 | Reswick | 5/451 |
| 4,015,299 | 4/1977 | Tinnel | 5/451 |
| 4,073,019 | 2/1978 | Fraser | 5/451 |
| 4,092,750 | 6/1978 | Ellis | 5/413 |
| 4,139,920 | 2/1979 | Evans | 5/455 |
| 4,192,031 | 3/1980 | Fogel | 5/451 |
| 4,310,936 | 1/1982 | Benjamin | 5/450 |
| 4,513,463 | 4/1985 | Santo | 5/452 |

FOREIGN PATENT DOCUMENTS 0190113 6/1986 European Pat. Off. .

*Primary Examiner*—Alexander Grosz

*Attorney, Agent, or Firm*—Cushman, Darby & Cushman

[57] ABSTRACT

A water bed, comprising a box opening upwards and a watertight, closed bog placed in said box. The upper side of said bag consists of a flexible, elastic material the edge portions of which are provided with securing means intended for releasable engagement with complementary securing means on the outside of the side walls of said box in order to keep the upper side of said bag stretched. The underside of said bag is designed for depending from the stretched upper side of said bag in contact with the inside of said box when filled with water. The inside of the box is shaped in accordance with the rear/dorsal side of a human body by the aid of elongated flexible cases that are filled with a light-weight filler and are provided on the bottom of the box. In the bag an air mattress is loosely arranged, which in an inflated and non-loaded state will float beneath the upper side of the bag in order to provide a more firm support surface that is adjustable by changing the air pressure in said air mattress.

5 Claims, 2 Drawing Figures

WATER BED

Figure 1:
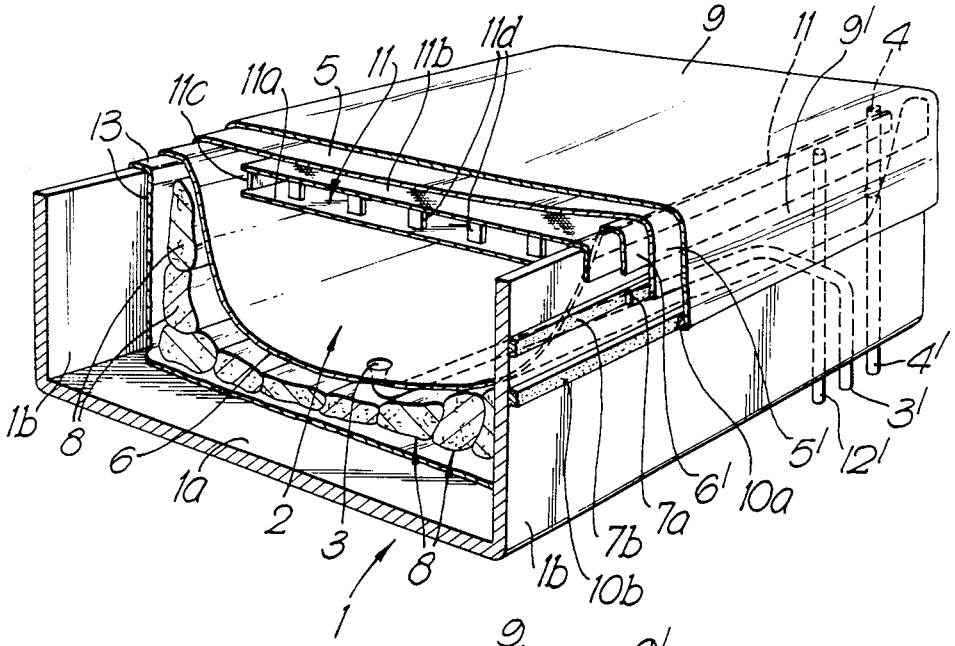

The present invention relates to a water bed, preferably for use in the home and, especially, for use as a therapy water bed. Conventional water beds comprise a plastic bag with water that is placed in a box. The volume of water may vary from approx. 400 kg to approx. 1000 kg. The support surface is flexible, but not elastic. When a person lies in a conventional water bed the support surface becomes rigid/firm due to the tension in the material of said plastic bag resulting from the load caused by the body weight of said person. In conventional water beds the support surface will adapt well to the body in its longitudinal direction but there is little adaption to the body's shape transversally. A person lying on a conventional water bed, thus, will not sink down into the support surface of the bed to such a degree that it is not easy to turn over. In a therapy water bed the support surface consists of a flexible and elastic material, e.g. as known from the applicant's Norwegian Patent (Application No. 85 0345). In such a therapy water bed the user will sink further down into the support surface which will, thus, cause more relief from pressure against the body in all lying positions than what is achieved in conventional water beds, where the person will not sink correspondingly far down and where the surface pressure against the body is, thus, higher.

Experience of the use of therapy water beds for treatment show that it results in a strong relaxation effect in the patient/client. This effect is, now, used as a method in treating, inter alia, nervous afflictions and in cases of serious sleeplessness.

It is an object of the present invention to provide a water bed for use in the home, that is also suitable as a therapy water bed, and that is considerably more lightweight than the conventional water beds mentioned above, the volume of water being reduced and where the water mattress itself is designed in such a manner that any traditional bed comprising a box shape, i.e. side walls and end walls with a bottom, may be changed into a water bed by just exchanging the conventional mattress with a bag that may be filled with water, and with the characterizing features as stated in the characterizing part of the following independent claim, and as stated in the characterizing part of the following independent claims.

The water bed or therapy water bed according to the invention is designed to enable persons weighing up to 130 kg to lie and sit in all conceivable positions without contact witn the bed frame. In principle, no more water is, thus, needed in the bed than necessary for the person lying there only just to go clear of the frame.

A water bed for use in the home is mostly used by one and the same person, so that it would be ideal to be able to shape the bed after the rear shape of said person and at the same time maintain said qualities of the supporting surface. In such a bed its weight may be reduced to a minimum due to the reduced demand for volume of water.

In conventional water beds this is not possible because they need a minimum number of liters of water and bag surface on which to distribute the pressure. If the bag is too small or too low a person will sink down to the frame and the supporting surface is forced up along the sides of said person by the water. In order to avoid this in "small water beds" so called water mattresses for hospitals, top and bottom of the plastic bag are connected with each other by ties, or the plastic bag is shaped with channels. When a person lies on such a water mattress the pressure within said mattress will, thus, increase and create tensile stresses in the supporting surface which becomes more firm than in conventional water beds.

Figure 2:
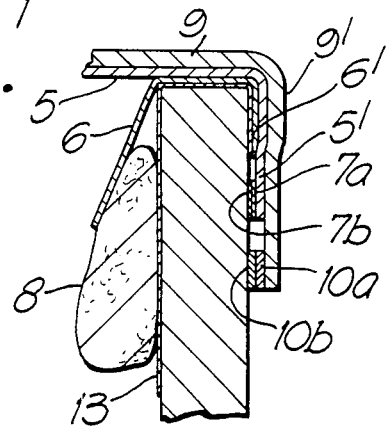

An embodiment of the invention will be discussed below with reference to the drawings in which FIG. 1 is a perspective view, partly broken away, of a water bed embodying the principles of the present invention, and FIG. 2 is a fragmentary sectional view of part of the bed of FIG. 1.

The water bed comprises a box shaped frame 1 that is open upwards, and a water tight closed bag 2 made of a flexible sheeting and with an opening 3 for filling and emptying water, resp., and a vent opening 4 for venting the bag, e.g. when water is filled into it, said bag being provided in the frame. The upper side 5 of bag 2 consists of a flexible, elastic material, e.g. a rubber cover, and the underside 6 preferably, consists of a PVC-sheeting. Sheeting 6 and rubber sheeting 5 are glued and stitched together along their edges 5' and 6' to form water tight joints. The underside 6/PVC sheeting of said bag is shaped with a larger surface area than the upper side 5 of the bag 2. The underside will, thus, conform with the shape of frame 1 and can be bent over the frame edge with said upper side 5 of the bag 2 which is stretched across the frame edges and is secured to the outside of side walls **1*b* of the frame 1 by securing means 7*a* at the edge portions 5' of said upper side, said securing means 7*a* cooperating with complementary securing means 7*b* outside the side walls 1*b* of said frame 1. Securing means 7*a* and 7*b* are, preferably, hook and loop fasteners such as are sold under the trademark Velcro permitting the bag 2 to be attached and released, resp. from said frame 1 as desired. In the bottom of bag 2 a connection with a hose is secured forming the opening 3 for filling/emptying water. Said hose is extended to the bottom 1*a* of frame 1 adjacent side wall 1*b* and opens outwards with a connection 3' provided with a valve, not shown. In a corner of bag 2 a corresponding connection with a hose is provided to form the vent opening 4. The last mentioned hose is extended outwards at the bottom 1*a* of frame 1 with a connection 4' provided with a valve, not shown. On top of upper side 5 of bag 2 which forms said rubber cover there is a loose rubber cover having a desired thickness that may be varied to achieve a desired rigidity or buoyancy and, thus, the desired properties of the supporting surface. As mentioned, bag 2 is secured along the exterior sides of box frame 1 by the aid of a hook and loop fastener one portion of which is stitched and glued to edge portion 5', 6' of said rubber cover/PVC sheeting 5 and 6, and the other portion of which 7*b* is glued to side wall 1*b* of box frame 1. The portion 7*b* on frame 1 is secured at such a level on side wall 1*b* that rubber cover 5 will ie with the desired tension across the opening of frame 1. Said loose exchangeable rubber cover 9 lying on upper side 5 of bag 2 is adjusted according to the tension of upper side 5 of bag 1 and is secured by the aid of a hook and loop fastener 10*a*,10*b* in the same manner as upper side 5 of bag 2, to the outside of frame 1, but at a lower level than members 7*a*,7*b* securing the water bag 2. In this manner bag 2 and cover 9 can be adapted to various dimensions of box frame 1 by varying the level of portions 7*b*,10*b* on side wall 1*b* of the frame 1**.

The box frame 1 in which bag 2 is placed may be made from plastic, wood, chipboard, or the like. The bag 2 being adaptable to various frame dimensions it is possible to build box frames 1 adapted to various standard bed dimensions and then adapt bag 2 to the box frame 1.

If box frame 1 is not water tight a safety sheeting 13 of a water tight material may be provided in said frame underneath said water bag and extending upwards over the uper edges of frame 1. This safety sheeting is intended for collecting water in case of a possible leak of water bag 2. With the disclosed special design of the support surface of the water bed the user may determine the firmness of said support surface by varying the thickness of the removable cover 9. Also, it is achieved that there is no need for more water in the bag than to ensure that the user just is clear of the bottom 1*a* of frame 1. The inside of box frame 1 can then be shaped so as to be adapted to the shape of the body. It is previously known, especially in connection with therapy water beds for use in hospitals, to mould the box frame so as to have its bottom follow the longitudinal contour of the body of a person weighing 130 kg. Thus, all persons weighing less than 130 kg can use the bed without touching the container or box 1. The determined shape of the box will resut in there being excessive water in the bed when it is used by persons having a body weight of less than 130 kg. It would also be impractical to build special boxes 1 for each body shape and weight. In the water bed/therapy bed according to the present invention this "overweight problem" is eliminated by the fact that a light-weight filler of small plastic balls filled with air, polystyrene balls, or the like is provided between underside 6 of bag 2 and bottom 1*a* of box 1, thus to shape the bottom in accordance with the person who is to use the water bed.

Said filler cannot be kept loosely between bottom 6 of bag 2 and bottom 1*a* of box 1 because it will then be difficult to shape the material before bag 1 is filled with water. Also, when bag 1 is filled with water the filler material is fixed by the water pressure and cannot be moved for shaping the bottom.

In order to solve this problem the filler is provided in elongated cases 8 in the shape of "sausages". Said cases may consist of woven nylon. Such cases are easily moved and can be used for building up and shaping the bottom of box 1 in those volume areas of the box where pressurized water is not needed for use of the water bed.

For a possible adaption of the shape of the bottom of box 1 when bag 2 has been filled with water it is possible to release cover 9 by the aid of the fastener 10*a*,10*b* as well as water bag 2 by the aid of the fastener 7*a*,7*b*, then roll the bag away from the area where it is desirable to change the bottom shape of the box by displacing a case 8 or by adding or removing a case 8. This means that cases 8 or the sausages can be stacked to achieve a desired bottom shape in box 1. Bag 2 is then rolled back and secured by the aid of 7*a*, 7*b* with simultaneous stretching of the upper side 5, then cover 9 is stretched and secured in the same manner by the aid of the fastener 10*a*,10*b*. After this the volume of water in bag 2 can be adjusted via connection 3', if necessary.

Below bag 2 a thermostat controlled heating element (not shown) insulated against water may be provided to maintain a correct temperature in the water bed.

In case the water bed is to be used both for relaxation/therapy and for sleeping the support surface must be as soft as possible permitting maximum relaxation. The water bed may then become too soft, so that the user sinks so far down into the support surface that he or she has problems with turning over while asleep. In such cases an air mattress 11 may be arranged in bag 2 to be inflated from outside via connection 12' comprising a valve not shown. Said air mattress will then provide additional buoyancy in the water and increase the firmness of the support surface, so that the user will not sink further down into the support surface than to a level enabling him/her to turn about easily. In the disclosed water bed there is so little water in bag 2 that, with an air mattress 11 in use, there cannot arise waves of the kind that may be experienced in conventional water beds or in the known hospital versions of therapy water beds.

The air mattress 11 may, e.g. be provided with a flexible bottom 11*a* resistant to elongation and connected with a flexible, elastic top 11*b* via flexible side walls 11*c* resistant to elongation and spacing strips 11*d* uniformly distributed all over said bottom and top.

The disclosed structure of a water bed/therapy bed for use in the home permits 1. adaption of the mattress part comprising bag 2 to any standard bed dimensions;
2. reducing the weight of the mattress part so that it may be placed in ordinary beds, it only being necessary to replace the old mattress with the disclosed mattress part, i.e. bag 2 with cover 9, as well as provided securing means 7*a*,7*b* and 10*a*, 10*b*;
3. providing a support surface having the same properties as in case of the known hospital versions of therapy beds, said support surface being adaptable to any body weight by selecting the thickness of said cover 9 and, thus, adapting the firmness of said support surface;
4. washing, cleaning, and airing the support surface like a conventional mattress, said cover 9 being removable;
5. choosing whether the water bed is to be used only for relaxation—therapy water bed—, only for sleeping—water bed—, or for combined relaxation and sleeping—water bed/therapy bed.

Having described my invention, I claim:

1. A water bed, preferably for use in the home, and especially for use as a therapy bed, comprising an upwards open box having side walls and a water tight, closed bag placed in said box and made from a flexible sheeting material having an opening for filling and emptying water and a vent opening for venting said bag when water is introduced into said bag, characterized in that the bag has an upper side made of a flexible elastic material having edge portions which are provided with securing means for releasable engagement with complementary securing means externally on the side walls of said box in order to maintain said upper side of said bag stretched, and that said bag has an underside shaped to depend from the stretched upper side of said bag in contact with the inside of said box when the bag is filled with water, the inside of said box being shaped according to the longitudinal profile of the rear side of a human body by the aid of elongated flexible cases extending longitudinally of said box, said cases being filled with a light-weight filler, said cases being provided on the bottom of said box below the underside of said bag.

2. A water bed as in claim 1 wherein said elongated cases also shape the inside of the box according to the transverse profile of the dorsal side of a human body.

3. A water bed as in claim 1 wherein said light-weight filler comprise particles of foamed plastic or small plastic balls filled with air.

4. A water bed, preferably for use in the home, and especially for use as a therapy water bed, comprising an upwards open box having side walls and a water tight, closed bag placed in said box and made from a flexible sheeting material having an opening for venting said bag when water is introduced into said bag characterized in that the bag has an upper side made of a flexible elastic material having edge portions which are provided with securing means for releasable engagement with complementary securing means externally on the side walls of box in order to maintain said upper side of bag stretched, in that said bag has an underside shaped to depend from the stretched upper side of said bag in contact with the inside of said box when the bag is filled with water, and in that there is a cover of flexible elastic material cooperating with the upper side of the bed, said cover having edge portions provided with securing means cooperating with securing means located on the outside of the side walls of said box and below the securing means for the upper side of said bag.

5. A water bed, preferably for use in the home, and especially for use as a therapy water bed, comprising an upwards open box having side walls and a water tight, closed bag placed in said box and made from a flexible sheeting material having an opening for filling and emptying water, resp., and a vent opening (4) for venting said bag when water is introduced into said bag, characterized in that the bag has an upper side made of a flexible elastic material having edge portions which are provided with securing means for releasable engagement with complementary securing means externally on the side walls of of said box in order to maintain said upper side of said bag stretched, in that said bag has an underside shaped to depend from the stretched upper side of said bag in contact with the inside of said box when the bag is filled with water, and in that there is an air mattress within said bag arranged to float beneath the upper side of said bag when said mattress is in an inflated and unloaded state thereby providing a more firm support surface that may be adjusted by changing the air pressure in said mattress, there being an air supply passage extending from the bag through said box.

* * * * *